US010166562B2

(12) United States Patent
Batinkoff et al.

(10) Patent No.: US 10,166,562 B2
(45) Date of Patent: Jan. 1, 2019

(54) PROTECTIVE CAP WITH DETACHABLE NOZZLE AND NOZZLE HOLDER

(71) Applicant: TOP SECRET INC., Santa Monica, CA (US)

(72) Inventors: Randall Batinkoff, Santa Monica, CA (US); Ian MacGillivray, Santa Monica, CA (US)

(73) Assignee: TOP SECRET INC., Santa Monica, CA (US)

( * ) Notice: Subject to any disclaimer, the term of this patent is extended or adjusted under 35 U.S.C. 154(b) by 0 days.

(21) Appl. No.: 15/402,944

(22) Filed: Jan. 10, 2017

(65) Prior Publication Data

US 2018/0193856 A1 Jul. 12, 2018

(51) Int. Cl.

| | |
|---|---|
| ***B05B 11/00*** | (2006.01) |
| ***B65D 83/30*** | (2006.01) |
| ***B65D 25/48*** | (2006.01) |
| ***B67D 7/40*** | (2010.01) |
| ***B65D 47/06*** | (2006.01) |

(52) U.S. Cl.

CPC ..... *B05B 11/001* (2013.01); *B65D 25/48* (2013.01); *B65D 47/068* (2013.01); *B65D 83/303* (2013.01); *B67D 7/40* (2013.01)

(58) Field of Classification Search

CPC .... B65D 47/068; B65D 25/48; B65D 83/303; B05B 11/001; B05B 15/061; B67D 7/40

USPC ..... 222/530, 538, 540, 153.13; 248/79

See application file for complete search history.

(56) References Cited

U.S. PATENT DOCUMENTS

| | | | | |
|---|---|---|---|---|
| 2,029,408 | A | 2/1936 | Bramsen et al. | |
| 3,162,370 | A | 12/1964 | Moonan et al. | |
| 3,237,819 | A | 3/1966 | Fillmore | |
| 3,371,827 | A * | 3/1968 | Micallef | B65D 47/2012 222/507 |
| 3,729,119 | A * | 4/1973 | Sette | B65D 83/206 222/153.11 |
| 4,007,858 | A | 2/1977 | Shay | |
| 4,096,974 | A * | 6/1978 | Haber | B65D 47/2043 222/402.13 |
| 4,307,823 | A | 12/1981 | Heiss et al. | |
| 4,819,838 | A * | 4/1989 | Hart, Jr. | B65D 83/303 222/538 |
| 4,972,974 | A * | 11/1990 | Chavkin | B05B 11/3059 222/153.11 |
| 5,027,982 | A * | 7/1991 | Demarest | B65D 83/205 222/182 |
| 5,065,943 | A | 11/1991 | Boger et al. | |
| 5,178,354 | A * | 1/1993 | Engvall | B65D 23/12 215/391 |
| 5,289,833 | A | 3/1994 | McDonald | |

(Continued)

*Primary Examiner* — Nicholas J Weiss

(74) *Attorney, Agent, or Firm* — Pergament & Cepeda LLP; Milagros Cepeda; Edward Pergament

(57) ABSTRACT

The present invention relates to a protective applicator cap that can be used with an applicator device that dispenses dry powders including hair fibers. The protective applicator cap comprises of a) cutout for a spray nozzle b) a detachable spray nozzle and c) nozzle holder clamp. The present invention is to provide an applicator cap that keeps pump top of an applicator clean by preventing the escape or spilling of hair fibers. The applicator cap of the present invention also affords a compact look to the applicator that makes it easy for a user to carry it during travel.

5 Claims, 3 Drawing Sheets

Applicator Cap
(Attached to applicator)
FRONT SIDE VIEW

(56) References Cited

U.S. PATENT DOCUMENTS

| | | | | |
|---|---|---|---|---|
| 5,310,095 | A | 5/1994 | Stern et al. | |
| 5,431,343 | A | 7/1995 | Kubiak et al. | |
| 5,558,247 | A * | 9/1996 | Caso | B65D 23/12 220/735 |
| 5,649,645 | A * | 7/1997 | Demarest | B65D 83/205 222/153.07 |
| 5,988,575 | A * | 11/1999 | Lesko | B65D 69/00 211/60.1 |
| 6,053,436 | A | 4/2000 | Morford | |
| 6,168,781 | B1 | 1/2001 | Ukaji et al. | |
| 6,315,152 | B1 * | 11/2001 | Kalisz | B65D 83/303 215/390 |
| 6,412,671 | B1 * | 7/2002 | Riley | B65D 83/303 222/402.1 |
| D517,913 | S * | 3/2006 | Mouyos | D9/434 |
| D519,372 | S * | 4/2006 | Hsieh | D6/542 |
| D599,215 | S | 9/2009 | Mulhauser et al. | |
| 7,841,494 | B2 * | 11/2010 | Batinkoff | B05B 11/062 222/207 |
| D638,306 | S * | 5/2011 | Havrileck | D9/688 |
| 8,172,115 | B1 * | 5/2012 | Mulhauser | B05B 11/062 222/209 |
| 8,464,896 | B2 * | 6/2013 | Beary | A47G 19/2222 220/705 |
| 8,590,743 | B2 * | 11/2013 | Beland | B65D 83/205 222/1 |
| 2007/0187436 | A1 * | 8/2007 | Oran | B65D 83/303 222/530 |
| 2011/0297763 | A1 | 12/2011 | Kressy et al. | |
| 2015/0201732 | A1 | 7/2015 | Kakon et al. | |

* cited by examiner

FRONT TOP VIEW

Applicator Cap (Attached to applicator)

FRONT SIDE VIEW

Applicator Cap
(Nozzle in holder)
BACK SIDE VIEW

RIGHT TOP VIEW

Applicator Cap (Nozzle inserted to applicator)

RIGHT SIDE VIEW

TOP SECRET APPLICATOR CAP
SCALE: 1" = 1" (actual size)

PROTECTIVE CAP WITH DETACHABLE NOZZLE AND NOZZLE HOLDER

FIELD

The present invention relates to a protective applicator cap that is designed to be used with applicators that dispense dry powders including cosmetic media such as hair fiber materials. More specifically, the present invention is designed to be used with an applicator device comprising a pump cap dispenser, for example, like the one described in U.S. Pat. No. 7,841,494.

BACKGROUND

Over the years numerous powder and fiber dispensers have been described in the art. Some dispense powder by squeezing the soft walls of the container forcing powder or fiber to flow outwards (U.S. Pat. No. 4,307,823) or some function like a talcum powder dispenser (U.S. Pat. No. 3,238,819). Other dispensers use a rubber or plastic bulb that is connected to a container with a tube mounted on it. By squeezing the bulb or cap, air is compressed into the container that contains the powder or fibers, agitating them and causing them to dispense through a nozzle. (U.S. Pat. No. 4,007,858). Another dispenser (U.S. Pat. No. 6,168,781, U.S. Pat. No. 3,162,370) requires a separate compressed tank, one or two chambers of fiber or powder.

None of these dispensers however are compact enough for travel since they are subject to spilling and wastage of the internal material such as dry powder, hair fiber media contained therein. More specifically, they do not provide any means to prevent compression of the applicator's bulb that causes unintended discharge of the material during travel. Further, most of them have fixed nozzles for dispensing internal material, which protrude out of the applicator, occupying a lot of space thereby making it inconvenient for a user to carry it a purse or a travel bag. The protruding nozzle also does not let a seller display the applicators in a compact way on the shelf.

The inventor of the present patent application has previously described a hand held spraying-dispensing device for dispensing variety of powders and fibers in U.S. Pat. No. 7,841,494, which is incorporated herein by reference. While this is an improvement over the available designs, the applicator device that comprises of a pump dispenser with an elastic dome, does not have a protective cap to prevent the dome from getting dirty or prevent unintended discharge of the material during travel.

The present invention solves the problems discussed above. The present invention provides an applicator cap that covers and protects the dome of a pump dispenser in an applicator device. For example, the present invention provides an applicator cap that covers and protects the dome of the pump dispenser as described in U.S. Pat. No. 7,841,494. The applicator cap prevents unintended compression of the pump dispenser and discharge of internal materials during travel. The applicator cap provides a detachable nozzle that may be removed and secured safely when not in use. The applicator cap provides a means to cover and protect a spray outlet means when the nozzle is removed. These kind of protective caps with detachable nozzles have not been reported in the prior art applicators used towards cosmetic, personal care and other clinical purposes.

SUMMARY

A protective applicator cap for use with an applicator device that dispenses dry powder through a spray outlet hole, said applicator cap comprising: a top wall horizontal to the base of the applicator device when said applicator cap is attached to the applicator device; downward terminating cylindrical side wall descending all around from said top wall; a spray nozzle which is a hollow tube insertable into said spray outlet hole; a cutout for spray nozzle which is a single opening in the cylindrical side wall, said opening being rotatable between an open position overlying the spray outlet hole of said applicator device whereby it can receive and communicate with said spray nozzle, and a closed position wherein said opening is not overlying the spray outlet hole, the spray outlet hole being closed by said applicator cap; nozzle holder clamp attached to said cylindrical wall and adapted to receive the spray nozzle where said spray nozzle is not in use, wherein said spray nozzle being movable between an inserted position wherein it is attached to the spray outlet hole through said cutout, and a detached position when it is held by said nozzle holder clamp.

The applicator cap as described above, wherein the spray nozzle is perpendicular to said top wall in said detached position.

The applicator cap as described above, wherein the dry powder is hair fiber media.

The applicator cap as described above, wherein said fiber is hair increasing material.

The applicator cap as described above, wherein the spray nozzle dispenses a discharge which can be accurately directed at the head or body of a person.

The applicator cap as described above, wherein the spray nozzle dispenses a discharge with a precision enough to accurately reach eyebrows, mustache and beard of a user.

The applicator cap as described above, wherein the cap maybe adapted to the size of the applicator device.

The applicator cap of claim as described above, wherein the cap maybe adapted to the size of an applicator device that maybe conveniently carried in a purse, cosmetic bag or a travel bag.

DETAILED DESCRIPTION

The invention is defined with reference to the appended claims. With respect to the claims, the glossary that follows provides the relevant definitions.

The term "applicator" or "applicator device" as used herein shall mean a dispensing device that can dispense dry powders including hair fibers onto a scalp or other parts of the body. The applicator cap of the present application may be used with an applicator device that dispenses dry powders. More specifically, the applicator cap of the present application may be used with an applicator device that dispenses hair fibers. The applicator cap of the present application is used on an applicator device comprising a pump dispenser, for example the pump dispenser as described in U.S. Pat. No. 7,841,494, which is incorporated herein by reference.

"Dry powder" according to this invention may be defined as any powder such as face powder, bath powder, talcum powder, baby powder or other powders that are intended to be applied to the human body for cleansing, beautifying, promoting attractiveness. Baby powder as defined above may be dusting powder or an astringent powder with a base such as cornstarch or talcum powder, and further comprising ingredients to protect, soften and absorb moisture on the skin of a baby. More specifically, dry powder includes "Hair fiber media" or "hair fibers" which are short fibers such as natural fibers, human hair, wool, cotton and silk or regenerated fiber thereof and synthetic fiber, cellulose fiber or carbon fiber such as nylon, vinylon and polyester. The color of the powder or fiber maybe natural skin color, black or the like similar to human hair color or any other preferable color of which can be dyed such color. The average diameter and length of the media in the form of a powder or fiber preferably is such that it would easily fit through the spray nozzle. The fibers may be non-magnetized, magnetized either entirely or over only a fraction of their length or a combination of fibers with these properties.

Dry powder according to this invention may also include insecticides, insect repellents or fungicides, wherein the said powder contains an active ingredient in an amount that is effective for the intended purpose of the composition, for example to exterminate insects, rodents and other critters.

Figure 2:
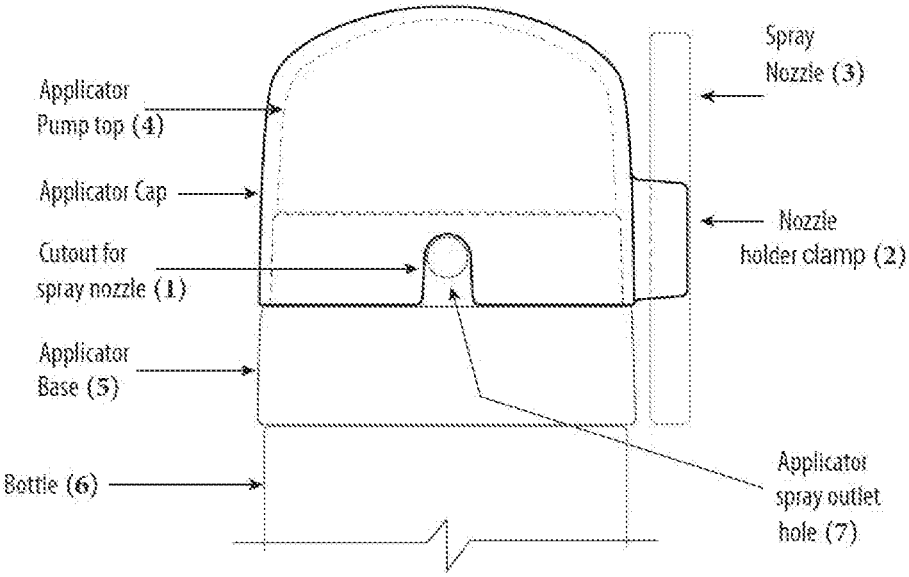
FIG. 2 shows the front side view of the applicator cap with the spray nozzle attached to the applicator cap at the nozzle holder clamp in accordance with an embodiment of the invention.

For the purposes of this invention, as illustrated in FIG. 2 of the application, the "applicator device" comprises of an "applicator pump top (4)", an "applicator base (5)", an "applicator spray outlet hole (7)" and a "bottle (6)" or "receptacle". The "applicator pump top" is the same as the "pump dispenser" that is described in U.S. Pat. No. 7,841,494. The applicator pump top comprises of a deformable dome with an empty chamber of air within it. The inside of the pump top has three passageways: (1) An air intake valve with a check valve that opens from outside into the dome through a wide flared opening. (2) a long passageway that pushes through a check valve from the dome to the receptacle. (3) A third passageway that connects the bottom of the cap with an opening to the receptacle to a flared opening exit to outside. The applicator pump top has an opening that is adapted to couple to the receptacle via the applicator base so as to form a substantially airtight seal between them. The receptacle is constructed such that it is capable of holding dry powders or hair fiber media. Further, the receptacle may be adapted to contain a quantity of a powder or fiber to be dispensed and is formed with side walls, a base and a neck portion.

The applicator pump top may be adapted with respect to the size of the deformable dome. A smaller size of the dome reduces the overall size of the pump dispenser making it more compact. The smaller size of the dome also makes the cap suitable for dispensing material from receptacles that are smaller in size without making the applicator device look bulky. The smaller dome eliminates clumping of the internal materials or the hair fiber by making it impossible to apply too many fibers at once.

The applicator pump top may also be adapted to not include a fixed "media outlet tube" or "spray nozzle" that dispenses the dry powder or the hair fiber media to the outside. Instead, as shown in FIG. 2 of the application, the applicator may comprise a "spray outlet hole" that can receive a removable spray nozzle. The spray outlet hole draws and disperses the dry powder from the receptacle onto the intended area through the spray nozzle.

The "applicator cap" of the present application refers to a protective cap that easily fits over the applicator device as described above and as illustrated in FIG. 2 of the application. In other words, the applicator cap may be coupled to the applicator device by fitting on top of the Applicator base. Additionally, the applicator cap of the present invention may be adapted to fit over any obvious adaptation of the above described applicator device or an adaptation of an applicator device with the pump dispenser as described in U.S. Pat. No. 7,841,494.

The coupling mechanism between the applicator cap and the base may be of the type including threads for threaded engagement of the inner surface of the cap with a threaded neck on the applicator base. Alternatively, the coupling mechanism may of the type including wedges so as to wedge the sides of the lower end of the applicator cap into the applicator device through grooves that are located on the outer side of the upper end of the applicator base. The coupling of the cap with base with either of the above means attaches the cap to the applicator device forming an airtight seal.

The attachment of the applicator cap to the applicator device completely covers the area of the applicator pump top excluding the applicator spray outlet hole to the outside environment. Alternatively, the attachment of the applicator cap to the applicator device may cover the applicator pump top including the Applicator spray outlet hole when the said cap is rotated over the Applicator base to cover the said Applicator outlet hole.

The applicator cap has a substantially uniform wall thickness with a top wall that is horizontal to the base of the applicator device when the cap is attached to the applicator device. The top wall has downward terminating cylindrical side wall descending all round from said top wall. The cylindrical side walls may either be terminating straight down in a non-angular fashion with a uniform internal diameter from top to the bottom, or be descending downwards with an increasingly wider diameter towards the lower end of the cap. In either case, the applicator cap has sufficient circumference to fit and seal with the base of the applicator device.

Figure 4:
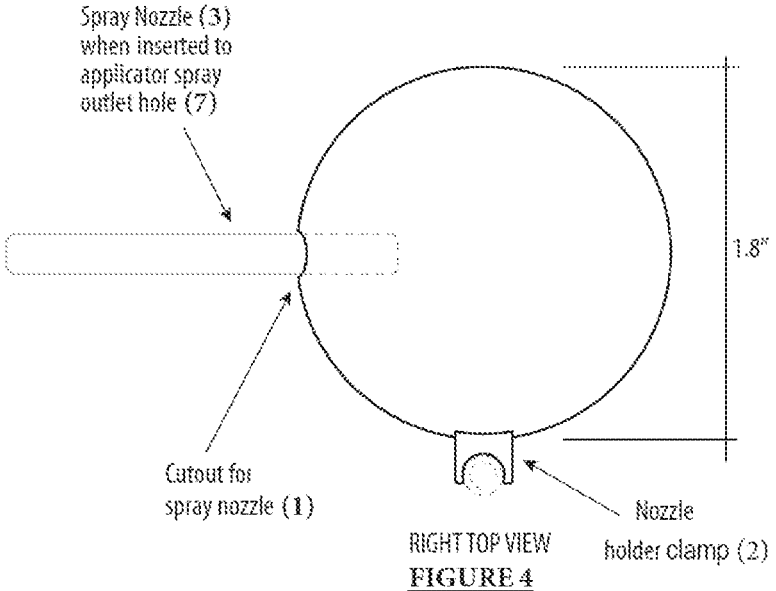
FIG. 4 shows the right top view of the applicator cap with the spray nozzle inserted into a spray outlet hole of the applicator in accordance with an embodiment of the invention.
Figure 5:
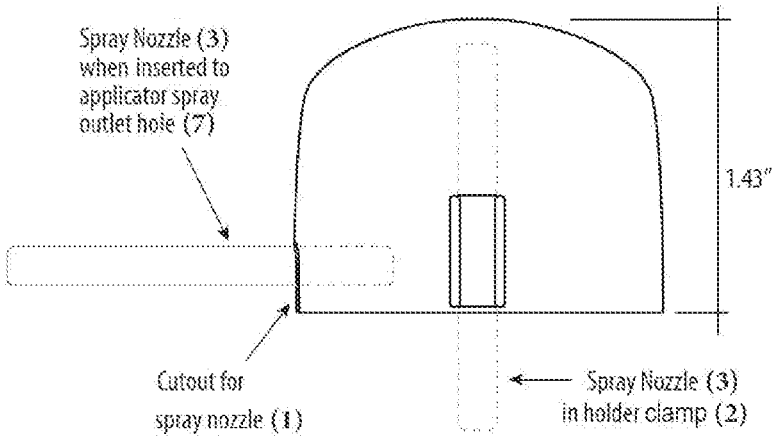
FIG. 5 shows the right side view of the applicator cap with the spray nozzle inserted into a spray outlet hole of the applicator in accordance with an embodiment of the invention.

The material of the applicator cap may be plastic, metal, wood or other polymer material. With regard to the particular dimensions of the applicator cap of the present invention, the applicator cap is constructed such that it fits over the applicator base as shown in FIG. 2 of the application. Further, as shown in FIGS. 4 and 5 of the application, the height of the applicator cap maybe 1 to 6 inches, preferably at least 1 to 1.6 inches and the diameter of the widest part of the applicator cap maybe 1 to 3 inches, preferably at least 1 to 2.0 inches.

The applicator cap of the application broadly comprises of the following function parts: (a) a cutout for spray nozzle (1), (b) a nozzle holder clamp (2) and (c) a spray nozzle (3).

A "spray nozzle", as illustrated in the drawings is a hollow tube insertable into the spray outlet hole, designed to deliver or dispense the internal contents of the receptacle. In other words, the spray nozzle is a detachable part that is movable between an inserted position wherein it is "attached" to the spray outlet hole through the cutout and a "detached" position wherein the spray nozzle is securely clamped into a nozzle holder clamp perpendicular to the top wall of the applicator cap when said cap is attached to the applicator device.

The spray nozzle may be a hollow round tube with a consistent diameter throughout the tube enabling its attachment to the spray outlet hole on either ends. The spray nozzle may be differently sized or shaped. For example the spray nozzle maybe a hollow tube with a progressively decreasing internal diameter towards the dispensing end so as to enable a more fine and precise delivery of the internal contents onto the desired surface. Alternatively, the spray nozzle may comprise a wide flared opening towards the dispensing end to enable a delivery with a wider coverage on the desired area.

The spray nozzle may be adapted to a different length based on utility and convenience. In the preferred embodiment of the present invention, the length of the spray nozzle is at least 1 to 1.5 greater than the length of the applicator cap. The width or the outer circumference of the spray nozzle is such that it is equal or slightly less than the circumference of the spray outlet hole enabling an airtight connection between the two and a precise delivery of the dry powder from the receptacle to outside without any leaks. Further, the width or the outer circumference of the spray nozzle is constructed such that it is snugly fit into the nozzle holder clamp and can be conveniently detached therefrom.

A "nozzle holder clamp" as illustrated in the drawings is attached to the cylindrical wall of the applicator cap and adapted to receive the spray nozzle when the spray nozzle is not in use or in "detached" position. In other words, the nozzle holder provides means for securely, but removably attaching the spray nozzle to the applicator cap. The nozzle holder clamp may comprise a clamping means contoured to fit and securely receive the spray nozzle when said spray nozzle is not in use. The nozzle holder may also be adapted to hold the spray nozzle by a different means including but not limited to clip mechanism, fastening mechanism, suction mechanism or any other clamping means.

Figure 1:
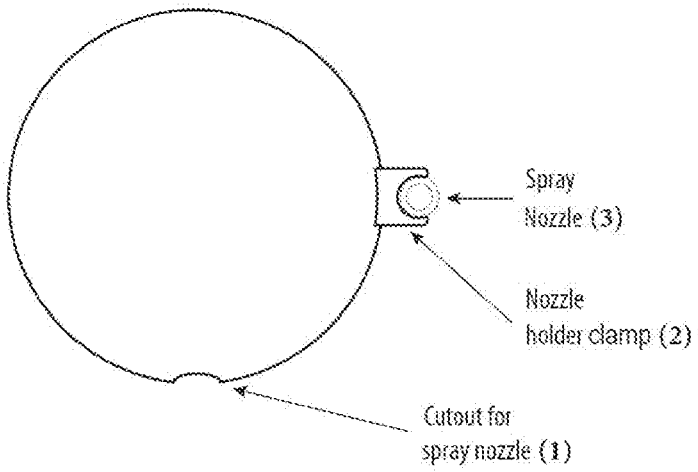
FIG. 1 shows the front top view of the applicator cap with the spray nozzle attached to the applicator cap at the nozzle holder clamp in accordance with an embodiment of the invention.
Figure 3:
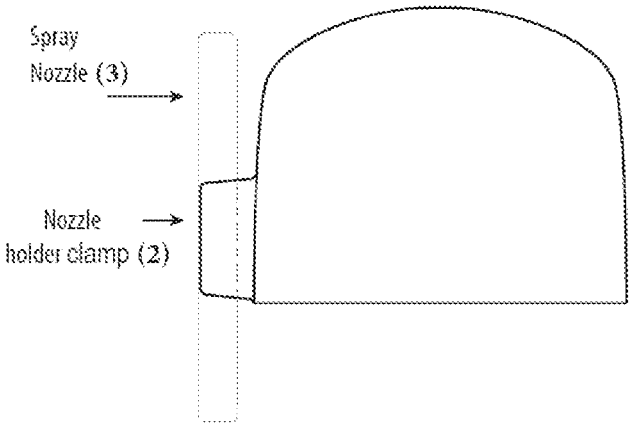
FIG. 3 shows the back side view of the applicator cap with the spray nozzle attached to the applicator cap at the nozzle holder clamp in accordance with an embodiment of the invention.

Specifically, the nozzle holder comprises a U-shaped protrusion from the applicator cap that is contoured to fit, receive and securely hold the spray nozzle tube. FIG. 2 of the application illustrates the front side view of the applicator device with the spray nozzle securely clamped into the complimentarily contoured base of the nozzle holder clamp. FIG. 1 and FIG. 3 of the application illustrate the front top view and the back side view of the same arrangement respectively. When the applicator cap is attached to the applicator device, the spray nozzle clamped into the nozzle holder clamp is perpendicular to the top wall of the applicator cap. The nozzle holder clamp may be adapted to hold differently shaped and sized spray nozzles.

The nozzle holder clamp may further comprise a base for supporting the clamp protrusion and a connecting component for connecting the base to the surface of the applicator cap. Preferably, the nozzle holder clamp is adjacent to the cutout for spray nozzle. The nozzle holder clamp may be located on the side wall of the applicator cap to enable the spray nozzle to be clamped perpendicular to the top wall of the applicator cap. This arrangement affords a compact space saving feature to the applicator device that is useful during travel for storage in a purse or a cosmetic bag. Smaller versions of the applicator device with the said applicator cap may even be carried in a pocket. Similarly, this arrangement provides a more compact, less space occupying means on a sales counter or on a vanity countertop.

A "cutout for the spray nozzle" as illustrated in the drawings refers to a single opening in the cylindrical wall of the applicator cap. The cutout for the spray nozzle may be an inverted U-shaped opening on the lower end of the applicator cap providing sufficient clearance to insert the spray nozzle into the Applicator spray outlet hole. The cutout for the spray nozzle maybe adapted to a different size or shape based on the shape of the spray nozzle such that the clearance of the cutout is equal to greater than the size and shape of the spray nozzle. The top view of the applicator device with the cutout for spray nozzle is shown in FIG. 1 of the application. The front side of the applicator cap with the inverted U-shaped opening of the cutout for spray nozzle is shown in FIG. 2 of the application.

The cutout for spray nozzle is rotatable between an "open" position overlying the spray outlet hole of said applicator device whereby it can receive and communicate with the detached spray nozzle and a "closed position" wherein said opening is not overlying the spray outlet hole. When the cutout is rotated to the closed position wherein the opening is not overlying the spray outlet hole, the hole is closed by the sidewalls of the applicator cap. Specifically, the applicator cap has a sliding means over the base of the applicator device wherein a user can rotate the cap such that the sidewalls of the applicator cap cover the spray outlet hole. The sliding mechanism may be of the type including threads for threaded engagement of the inner surface of the cap with the threaded neck on the base. Alternatively, the coupling mechanism may be of the type including wedges so as to wedge the lower end of the applicator cap into the applicator device through grooves that are located on the outer sides of the upper end of the applicator base.

FIG. 4 of the application shows the right top view of the cutout for spray nozzle when the spray nozzle is inserted into the spray outlet hole of the applicator device. FIG. 5 of the application shows the right side view of the applicator cap with the cutout for spray nozzle when the spray nozzle is inserted to the applicator spray outlet hole. This arrangement wherein the applicator cap is attached to the applicator device with the spray nozzle inserted into the spray outlet hole enables a daily user to use or dispense the dry powder while at the same time protecting the dome of applicator pump from getting dirty. The applicator cap maybe removed while dispensing of the hair fiber and reattached as soon as the user is finished with dispensing.

In order to use the applicator device, a user removes the applicator cap and inserts the spray nozzle into the spray outlet hole. The applicator is then actuated by grasping in the palm of one hand and manually pressing with any finger or the hand down on the bulb of the applicator at a pressure sufficient to force the dry powder or hair fibers from the receptacle. The fibers pass the spray outlet hole and enter the spray nozzle opening to be dispensed onto the outside. Once the user finishes dispensing the material, the cap may be replaced onto the applicator device by aligning the cutout to the open position. This arrangement enables a user to cover the applicator thereby providing protection with the spray nozzle still inserted. This arrangement prevents the bulb of the applicator from getting dirty. This is ideal for a daily user who has a short term, frequent, non-travel usage. Such a user may place the applicator device with the said arrangement on his vanity or dressing countertop.

Alternatively, after dispensing of the material, the applicator cap may be replaced after detaching the spray nozzle.

If necessary, the spray nozzle may be ridden on any remnant dry powder or hair fiber by a quick puff of air from a hair dryer. The spray nozzle may then be clamped into the nozzle holder clamp such that it is perpendicular to the top wall of the applicator cap. The cap may then be rotated over the applicator base to the closed position. This is an economical, compact, space saving arrangement of the applicator device that is ideal for storage, travel, display and sale.

The applicator cap keeps a pump dispenser of the applicator device clean by preventing unintended compression of the dispenser that may lead to spillage of hair fibers. The applicator cap provides a detachable nozzle that may be clamped into a nozzle holder to make the applicator unit compact such that it takes less space on a counter or in a cosmetic/travel bag. The applicator cap also provides the utility of keeping the applicator dome clean for a daily user while the nozzle is still attached to the outlet hole.

While the invention has been described above with reference to specific embodiments thereof, it is apparent that many changes, modifications, and variations can be made without departing from the inventive concept disclosed herein, and such description is not intended as limitations on the scope thereof. Accordingly, it is intended to embrace all such changes, modifications, and variations that fall within the spirit and broad scope of the appended claims.

What is claimed is:

1. An apparatus for dispensing dry powder, said apparatus comprising:

an applicator device having a spray outlet hole; and a protective applicator cap, comprising:

a) a top wall horizontal to the base of the applicator device when said applicator cap is attached to the applicator device;

b) a downward terminating cylindrical side wall descending all around from said top wall;

c) a spray nozzle which is a hollow tube insertable into said spray outlet hole;

d) a cutout for said spray nozzle which is a single opening in the cylindrical side wall, said applicator cap being rotatable between an open position overlying the spray outlet hole of said applicator device whereby it can receive and communicate with said spray nozzle, and a closed position wherein said opening is not overlying the spray outlet hole, the spray outlet hole being closed by said applicator cap;

e) a nozzle holder clamp attached to said cylindrical wall and adapted to receive the spray nozzle when said spray nozzle is not in use, wherein said spray nozzle being movable between an inserted position wherein it is attached to the spray outlet hole through said cutout, and a detached position when it is held by said nozzle holder clamp;

wherein the applicator cap prevents discharge of dry powder in both the open position and the closed position.

2. The apparatus of claim 1, wherein the spray nozzle is perpendicular to said top wall in said detached position.

3. The apparatus of claim 1 wherein the dry powder is hair fiber media.

4. The apparatus of claim 3, wherein said hair fiber media is hair increasing material.

5. The apparatus of claim 1, wherein the spray nozzle dispenses a discharge which is concentrated at eyebrows, mustache and beard of a user.

* * * * *